US008585190B2

(12) United States Patent
Hiratsuka et al.

(10) Patent No.: US 8,585,190 B2
(45) Date of Patent: Nov. 19, 2013

(54) LIQUID SUPPLY CONTROLLER, LIQUID DROPLET DISCHARGE DEVICE, NON-TRANSITORY COMPUTER READABLE MEDIUM STORING PROGRAM, AND LIQUID SUPPLY CONTROL METHOD

(75) Inventors: Masashi Hiratsuka, Kanagawa (JP); Masaki Kataoka, Kanagawa (JP); Jun Isozaki, Kanagawa (JP); Hirotake Sasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 330 days.

(21) Appl. No.: 13/039,542

(22) Filed: Mar. 3, 2011

(65) Prior Publication Data

US 2012/0007902 A1 Jan. 12, 2012

(30) Foreign Application Priority Data

Jul. 8, 2010 (JP) ..... 2010-156097

(51) Int. Cl.
*B41J 2/175* (2006.01)
*B41J 29/393* (2006.01)

(52) U.S. Cl.
USPC ..... 347/85; 347/19

(58) Field of Classification Search
CPC ..... B41J 2/14233; B41J 29/38
USPC ..... 347/7, 9, 19, 84, 85
See application file for complete search history.

(56) References Cited

U.S. PATENT DOCUMENTS

| | | | | |
|---|---|---|---|---|
| 7,845,784 | B2 * | 12/2010 | Nitta et al. | 347/89 |
| 7,883,170 | B2 * | 2/2011 | Toyoda et al. | 347/17 |
| 7,976,139 | B2 * | 7/2011 | Kyoso et al. | 347/85 |
| 2009/0179937 | A1 | 7/2009 | Yamada | |

FOREIGN PATENT DOCUMENTS

| | | |
|---|---|---|
| JP | 2009-166307 | 7/2009 |

* cited by examiner

*Primary Examiner* — An Do
(74) *Attorney, Agent, or Firm* — Fildes & Outland, P.C.

(57) ABSTRACT

A liquid supply controller includes a liquid circulation controller that includes supply and recovery units of a liquid droplet discharge unit, and that circulates liquid according to a differential pressure between the supply unit and the recovery unit, a back pressure setting unit that sets a back pressure that is a discharge pressure based on supply and recovery pressures set by the liquid circulation controller, a circulation amount obtaining unit that obtains a flow rate of the liquid circulated; a judging unit that judges whether or not the obtained flow rate is a proper value, and a differential pressure adjusting unit that adjusts the differential pressure while maintaining the back pressure within an allowable range when it is judged that the flow rate is not the proper value.

14 Claims, 12 Drawing Sheets

CIRCULATION FLOW RATE DECREASE BY DECREASE OF DIFFERENTIAL PRESSURE ΔP
(BACK PRESSURE $P_{nzl}$ IS MAINTAINED)

CIRCULATION FLOW RATE INCREASE BY INCREASE OF DIFFERENTIAL PRESSURE ΔP
(BACK PRESSURE $P_{nzl}$ IS MAINTAINED)

CIRCULATION FLOW RATE DECREASE BY DECREASE OF DIFFERENTIAL PRESSURE ΔP
(BACK PRESSURE $P_{nzl}$ IS MAINTAINED)

CIRCULATION FLOW RATE INCREASE BY INCREASE OF DIFFERENTIAL PRESSURE ΔP
(BACK PRESSURE $P_{nzl}$ IS MAINTAINED)

FIG.10

118

| REVOLUTION AT DIFFERENTIAL PRESSURE FOR CALIBRATION △ Pd | A PAIR OF PRESSURES TO BE SELECTED |
|---|---|
| N-2 (ex. 100rpm) | Pin1, Pout1 (DIFFERENTIAL PRESSURE △P-2) |
| N-1 (ex. 110rpm) | Pin2, Pout2 (DIFFERENTIAL PRESSURE △ P-1) |
| N-0 (ex. 120rpm) | Pin3, Pout3 (DIFFERENTIAL PRESSURE△ P-0) |
| N+1 (ex. 130rpm) | Pin4, Pout4 (DIFFERENTIAL PRESSURE △ P+1) |
| N+2 (ex. 140rpm) | Pin5, Pout5 (DIFFERENTIAL PRESSURE △ P+2) |

LIQUID SUPPLY CONTROLLER, LIQUID DROPLET DISCHARGE DEVICE, NON-TRANSITORY COMPUTER READABLE MEDIUM STORING PROGRAM, AND LIQUID SUPPLY CONTROL METHOD

CROSS-REFERENCE TO RELATED APPLICATIONS

This application is based on and claims priority under 35 USC 119 from Japanese Patent Application No. 2010-156097 filed on Jul. 8, 2010.

BACKGROUND

1. Technical Field

The invention relates to a liquid supply controller, a liquid droplet discharge device, a non-transitory computer readable medium storing liquid supply control program, and a liquid supply control method.

2. Related Art

A configuration is conventionally proposed in which two tanks are respectively connected to the supply side and the recovery side of the head module (liquid droplet discharge unit) of an ink jet printer, so that ink is circulated according to a differential pressure between the two tanks. A differential pressure for circulation is generated between a positive-pressure tank due to water head difference and a negative-pressure tank controlled by a circulating pump. The circulation between the head module and the two tanks is performed according to the differential pressure, thereby maintaining a back pressure for forming a meniscus in the nozzle.

SUMMARY

According to an aspect of the present invention, there is provided a liquid supply controller including a liquid circulation controller that includes a supply unit that supplies a liquid to a liquid droplet discharge unit and a recovery unit that recovers the liquid from the liquid droplet discharge unit, and that circulates the liquid at least according to a differential pressure between a supply pressure of the supply unit and a recovery pressure of the recovery unit, a back pressure setting unit that sets a back pressure that is a discharge pressure of the liquid droplet discharge unit based on the supply pressure and the recovery pressure set by the liquid circulation controller, a circulation amount obtaining unit that obtains a flow rate of the liquid circulated by the liquid circulation controller, a judging unit that judges whether or not the flow rate obtained by the circulation amount obtaining unit is a proper value and a differential pressure adjusting unit that adjusts the differential pressure while maintaining the back pressure within an allowable range when the judging unit judges that the flow rate is not the proper value.

BRIEF DESCRIPTION OF THE DRAWINGS

Exemplary embodiments of the present invention will be described in detail based on the following figures, wherein:

FIG. 10 is a schematic diagram of a ROM which stores a table showing the relationship between a rotational speed and a pair of pressures according to modification example 2;

DETAILED DESCRIPTION (Overall Configuration)

In the present exemplary embodiment(s), an ink jet recording device which discharges ink droplets to record an image onto a recording medium is described as an example of a liquid droplet discharge device.

However, the liquid droplet discharge device is not limited to the ink jet recording device. The liquid droplet discharge device may be, for example, a color filter manufacturing device which discharges ink onto a film or a glass to manufacture a color filter, a device which discharges an organic electroluminescence (EL) liquid onto a substrate to form an EL display panel, a device which discharges melted solder onto a substrate to form a bump for parts mounting, a device which discharges a liquid including metal to form a wiring pattern, various film forming devices which discharge liquid droplets to form a film, and any other type of devices that discharge liquid droplets.

Figure 12:
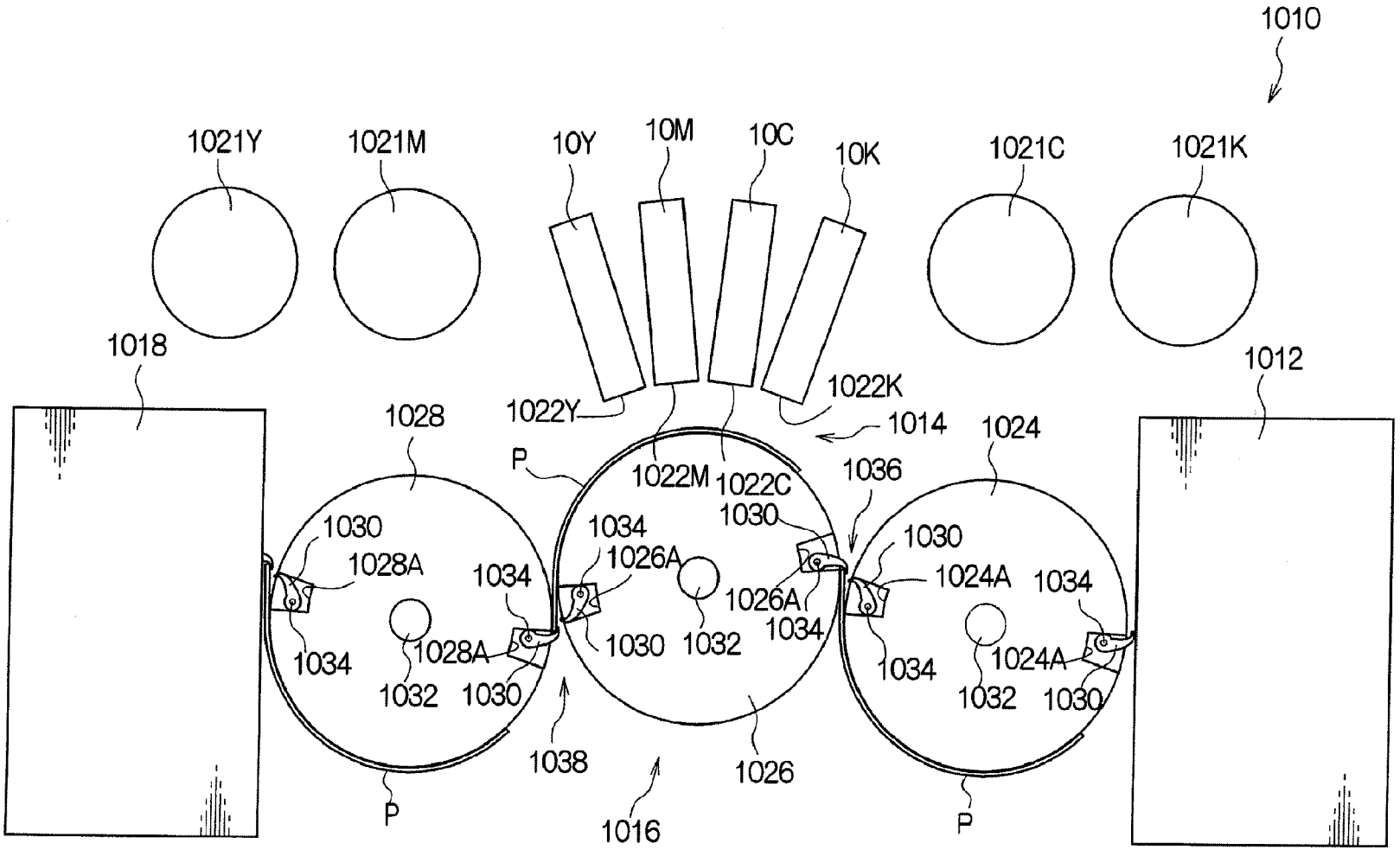
FIG. 12 is a schematic diagram showing the configuration of an ink jet recording device according to the present exemplary embodiment.

FIG. 12 is a schematic diagram showing the configuration of an ink jet recording device according to the present exemplary embodiment.

As shown in FIG. 12, an ink jet recording device 1010 has an recording medium containing unit 1012 which contains recording media P such as sheets, a recording unit 1014 which records an image onto each of the recording media P, a conveying unit 1016 which conveys the recording medium P from the recording medium containing unit 1012 to the recording unit 1014, and a discharge unit 1018 which discharges the recording medium P onto which an image has been recorded by the recording unit 1014.

The recording unit 1014 has, as an example of liquid droplet discharge heads, liquid droplet discharge devices (hereinafter, called "ink jet heads") 10Y, 10M, 10C, and 10K, which discharge ink droplets to record an image onto the recording medium. When the ink jet heads 10Y, 10M, 10C, and 10K are generically called, they may be denoted as "ink jet heads 10Y to 10K".

The ink jet heads 10Y to 10K have nozzle surfaces 1022Y to 1022K formed with nozzles (not shown), respectively. Each of the nozzle surfaces 1022Y to 1022K has a recordable region equal to the largest width of the recording medium P which the ink jet recording device 1010 is assumed to process, or more.

The ink jet heads 10Y to 10K are arranged in parallel from the downstream side in the conveying direction of the recording medium P in the color order of yellow (Y), magenta (M), cyan (C), and black (K), and discharge ink droplets corresponding to the respective colors from the plural nozzles by a piezoelectric method, thereby recording an image. It should be noted that the ink jet heads 10Y to 10K may discharge ink droplets by other methods such as a thermal method.

The ink jet recording device 1010 has, as reserving units which reserve liquid, ink tanks 1021Y, 1021M, 1021C, and 1021K (hereinafter, denoted as 1021Y to 1021K), which reserve inks of the respective colors. The ink tanks 1021Y to 1021K supply the inks to the ink jet heads 10Y to 10K. As the inks supplied to the ink jet heads 10Y to 10K, various inks such as water base ink, oily ink, and solvent ink may be used.

The conveying unit 1016 has a takeout drum 1024 which takes out each of the recording media P in the recording medium containing unit 1012, a conveying drum 1026 as a conveyer which conveys the recording medium P to the ink jet heads 10Y to 10K of the recording unit 1014 so that the recording surface (surface) of the recording medium P faces the ink jet heads 10Y to 10K, and a feeding drum 1028 which feeds the recording medium P on which an image has been recorded to the discharge unit 1018. Each of the takeout drum 1024, the conveying drum 1026, and the feeding drum 1028 holds the recording medium P on their circumferential surface by electrostatic absorption or non-electrostatic absorption such as suction and adhesion.

Each of the takeout drum 1024, the conveying drum 1026, and the feeding drum 1028 has, for example, two sets of grippers 1030 which grip and hold the end of the recording medium P at the downstream side in the conveying direction. Each of the three drums 1024, 1026, and 1028 may hold on their circumferential surface, in the present embodiment, up to two recording media P by the grippers 1030. The grippers 1030 are provided in two recess portions 1024A, 1026A, or 1028A formed to the circumferential surface of each of the drums 1024, 1026, and 1028.

Specifically, a rotational shafts 1034 is supported in parallel to a rotational shaft 1032 of each of the drums 1024, 1026, and 1028 in predetermined positions in the recess portions 1024A, 1026A, or 1028A. The plural grippers 1030 are fixed to the rotational shafts 1034 so as to be spaced in the axial direction. Due to the rotational shafts 1034 rotating in the forward and backward direction by an actuator, which is not shown, the grippers 1030 rotate in the forward and backward direction along the circumferential direction of each of the drums 1024, 1026, and 1028 in order to grip and hold or release the end of the recording medium P at the downstream side in the conveying direction.

That is, the grippers 1030 are rotated so that their ends are slightly projected from the circumferential surface of each of the drums 1024, 1026, and 1028, whereby the grippers 1030 of the takeout drum 1024 pass the recording medium P to the grippers 1030 of the conveying drum 1026 in a passing position 1036 where the circumferential surface of the takeout drum 1024 and the circumferential surface of the conveying drum 1026 face each other, and the grippers 1030 of the conveying drum 1026 pass the recording medium P to the grippers 1030 of the feeding drum 1028 in a passing position 1038 where the circumferential surface of the conveying drum 1026 and the circumferential surface of the feeding drum 1028 face each other.

The ink jet recording device 1010 also has maintenance units (not shown) which maintain the ink jet heads 10Y to 10K. Each of the maintenance units has a cap which covers the nozzle surface of each of the ink jet heads 10Y to 10K, a receiving member which receives preliminarily discharged (idle discharged) liquid droplets, a cleaning member which cleans the nozzle surface, and a suction device that draws out the ink inside the nozzle. The maintenance unit move to the opposite positions of the corresponding ink jet heads 10Y to 10K and perform various maintenances.

Next, the image recording operations of the ink jet recording device 1010 will be described.

The recording medium P taken out from the recording medium containing unit 1012 and held by the grippers 1030 of the takeout drum 1024 is conveyed while being absorbed onto the circumferential surface of the takeout drum 1024, and is passed from the grippers 1030 of the takeout drum 1024 to the grippers 1030 of the conveying drum 1026 in the passing position 1036.

The recording medium P held by the grippers 1030 of the conveying drum 1026 is conveyed to the image recording positions of the ink jet heads 10Y to 10K while being absorbed by the conveying drum 1026, and an image is then recorded onto the recording surface of the recording medium P by ink droplets discharged from the ink jet heads 10Y to 10K.

The recording medium P on which the image is recorded onto its recording surface is passed from the grippers 1030 of the conveying drum 1026 to the grippers 1030 of the feeding drum 1028 in the passing position 1038. Then, the recording medium P held by the grippers 1030 of the feeding drum 1028 is conveyed while being absorbed onto the feeding drum 1028, and is discharged to the recording medium discharge unit 1018. As described above, a series of the image recording operations are performed.

(Piping Configuration)

Figure 1:
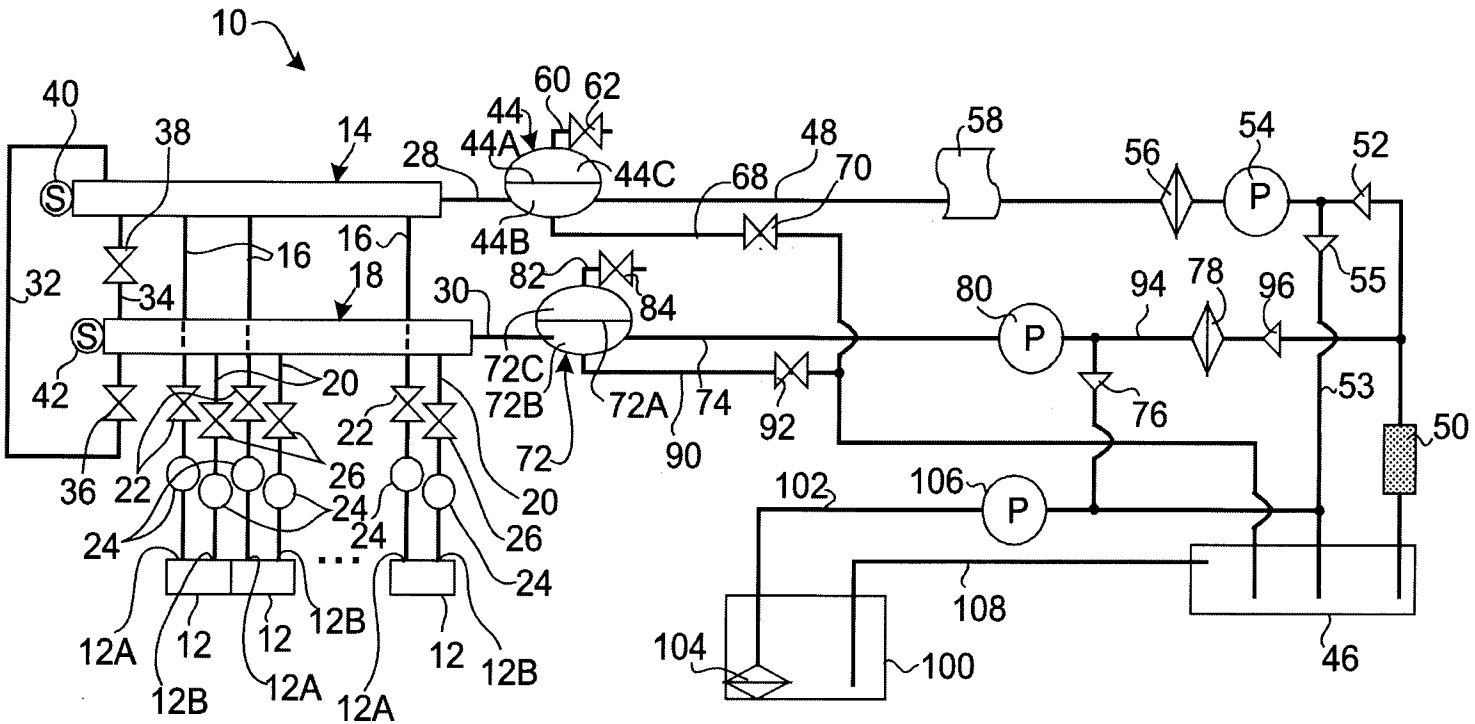
FIG. 1 is a piping diagram of an ink jet head of an ink jet printer according to the present exemplary embodiment.

FIG. 1 shows a piping diagram of the ink jet head 10 of an ink jet printer according to the present exemplary embodiment.

Plural liquid droplet discharge units (hereinafter, called "head modules") 12 are mounted to the ink jet head 10 of the present exemplary embodiment and an ink circulation piping path is formed for uniformly (at a fixed pressure and at a fixed flow rate) supplying the ink to the respective head modules 12.

As shown in FIG. 1, each of the head modules 12 has an input port 12A into which the ink flows, and an output port 12B from which the ink flows out. The end of a supply branch pipe 16 branched from a supply manifold 14 is connected to the input port 12A. The end of a recovery branch pipe 20 branched from a recovery manifold 18 is connected to the output port 12B. That is, the supply manifold 14 and the recovery manifold 18 have a number of branch pipes corresponding to the number of the installed head modules 12 (the supply branch pipes 16 and the recovery branch pipes 20). Each of the supply branch pipes 16 supplies the ink that has supplied to the supply manifold 14 to each of the head modules 12 at a predetermined pressure Pin and at a predetermined flow rate. Each of the recovery branch pipes 20 recovers the ink supplied to each of the head modules 12 from each of the head modules 12 to the recovery manifold 18 at a predetermined pressure Pout and at a predetermined flow rate.

That is, a differential pressure ΔP is generated between the pressure Pin on the supply side and the pressure Pout on the recovery side. As a result, in the head module 12, a back pressure Pnzl which is the average pressure of the total of the pressure Pin on the supply side and the pressure Pout on the recovery side is applied to the nozzle surface as an ink discharge port. The ink is held in the proper state in each of the plural printing nozzles provided in each of the head modules due to the back pressure Pnzl, and an energy generation element for ink discharge, which is not shown, performs discharge control of the ink according to image information (data).

Each of the supply branch pipes 16 has a supply valve 22 and a buffer device 24. Each of the recovery branch pipes 20 has a recovery valve 26 and the buffer device 24. Opening and closing operations of the supply valve 22 and the recovery valve 26 are performed when each of the head modules 12 is required to be operated. The buffer device 24 has the function of reducing the pressure fluctuations during the flow of the ink supplied from the supply manifold 14 or the ink recovered to the recovery manifold 18.

One end of a supply pipe 28 of an ink circulation piping system is attached to one end (the right end of FIG. 1) of the supply manifold 14 in the longitudinal direction. One end of a recovery pipe 30 of an ink circulation piping system is attached to one end (the right end of FIG. 1) of the recovery manifold 18 in the longitudinal direction.

A first communication passage 32 and a second communication passage 34 are provided between the other end (the left end of FIG. 1) of the supply manifold 14 and the other end (the left end of FIG. 1) of the recovery manifold 18. The first communication passage 32 has a first communication valve 36. The second communication passage 34 has a second communication valve 38. The first communication passage 32 and the second communication passage 34 are used for adjusting the pressure, the flow rate and the like between the supply manifold 14 and the recovery manifold 18. For instance, during a normal circulation (the flow from the supply manifold 14 to the recovery manifold 18), the first communication valve 36 is closed, the second communication valve 38 is opened, and only the second communication passage 38 is communicated.

A supply pressure sensor 40 and a recovery pressure sensor 42 are provided at the other end of the supply manifold 14 and the other end of the recovery manifold 18, respectively, and monitor the pressure of the ink flowing in the supply manifold 14 and the recovery manifold 18.

The other end of the supply pipe 28 coupled to the supply manifold 14 is coupled to a supply sub-tank 44. The supply sub-tank 44 is configured by two chambers and is sectioned by an elastic thin film member 44A. One of the two chambers is an ink sub-tank chamber 44B and the other is an air chamber 44C.

One end of a supply main pipe 48 for drawing the ink from a buffer tank 46 thereinto is coupled to the ink sub-tank chamber 44B. The opening at the other end of the supply main pipe 48 is immersed into the ink reserved in the buffer tank 46.

The supply main pipe 48 is provided with a deaerating module 50, a one-way valve 52, a supply pump 54, a supply filter 56, and an ink temperature adjuster 58 in this sequence from the buffer tank 46 to the supply sub-tank 44. With the driving force of the supply pump 54, any air bubbles are removed from the ink and the temperature of the ink is managed while supplying the ink reserved in the buffer tank 46 to the supply sub-tank 44.

The inlet side of the supply pump 54 is communicated with one end of a branch pipe 53 aside from the supply main pipe 48. The opening at the other end of the branch pipe 53 is immersed into the ink reserved in the buffer tank 46 via a one-way valve 55.

The supply pump 54 and the supply filter 56 adopted in the present exemplary embodiment are tube pumps which use a stepping motor (supplies the ink in an elastic tube while squeezing the tube by the rotational driving of the stepping motor). However, embodiments are not particularly limited to such pumps. Hereinafter, the revolution rates of the pumps are described equivalent to the revolution rate of a stepping motor.

An opening pipe 60 and a supply air valve 62 are mounted to the air chamber 44C of the supply sub-tank 44.

The ink sub-tank chamber 44B is coupled to one end of a drain pipe 68. The opening at the other end of the drain pipe 68 is immersed into the ink reserved in the buffer tank 46. The drain pipe 68 has a supply drain valve 70.

The supply sub-tank 44 is configured to trap air bubbles in the flow passage while circulating the ink. The air bubbles in the supply sub-tank 44 are returned to the buffer tank 46 due to the driving force of the supply pump 54 by opening the supply-drain valve 70, and are discharged from the buffer tank 46 which is opened into the atmosphere.

The other end of the recovery pipe 30 coupled to the recovery manifold 18 is coupled to a recovery sub-tank 72. The recovery sub-tank 72 is configured by two chambers and is sectioned by an elastic thin film member 72A. One of the two chambers is an ink sub-tank chamber 72B and the other is an air chamber 72C.

The ink sub-tank chamber 72B is coupled to one end of a recovery main pipe 74 in order to draw the ink from the buffer tank 46 thereto.

A one-way valve 76 is provided in the recovery main pipe 74, and due to the driving force of the recovery pump 80, the ink in the recovery sub-tank 72 is recovered to the buffer tank 46.

An opening pipe 82 and a recovery air valve 84 are provided to the air chamber 72C of the recovery sub-tank 72.

One end of a drain pipe 90 is coupled to the ink sub-tank chamber 72B. The other end of the drain pipe 90 is communicated with the drain pipe 68 of the supply sub-tank 44 via a recovery drain valve 92.

The recovery sub-tank 72 is configured to trap air bubbles in the flow passage while circulating the ink. The air bubbles in the recovery sub-tank 72 are returned to the buffer tank 46 due to the driving force of the recovery pump 80 by opening the recovery drain valve 92, and are discharged from the buffer tank 46 which is opened into the atmosphere.

In the present exemplary embodiment, the relative pressure difference between the supply pump 54 and the recovery pump 80 is set to be the supply pump pressure Pin>the recovery pump pressure Pout, and negative pressures are supplied for these pressures. That is, since the supply pressure of the supply pump 54 is a negative pressure and the recovery pressure of the recovery pump 80 is further a negative pressure, the ink flows from the supply manifold 14 to the recovery manifold 18, and the back pressure Pnzl of the nozzle of the head module 12 is maintained to a negative pressure ({(Pin+Pout)/2}). Accurately, the height positions of the supply manifold 14 and the recovery manifold 18 and the density of the ink are involved as the factors of the back pressure Pnzl, so these factors should be considered when setting the input pressure Pin and the output pressure Pout.

In the present exemplary embodiment, a pressurizing purge pipe 94 is provided in the head module 12, which communicates the inlet side of the recovery pump 80 and the outlet of the deaerating module 50 of the supply main pipe 48.

The pressurizing purge pipe 94 is provided with a one-way valve 96 and a recovery filter 76 in this sequence from the deaerating module 50 to the recovery pump 80.

When the interior of the head module 12 is pressurized to discharge the ink in order to remove air bubbles, in addition to the driving of the supply pump 54, the driving (rotation) direction of the recovery pump 80 is reversed with respect to the normal operation so that the ink is supplied from the buffer tank 46 to the recovery manifold 18.

The buffer tank 46 is communicated with a main tank 100 (corresponding to the ink tanks 1021Y, 1021M, 1021C, and 1021K shown in FIG. 12). The buffer tank 46 reserves an amount of the ink necessary for circulating the ink and the ink is refilled from the main tank 100 according to ink consumption. One end of a refilling pipe 102 is immersed into the ink reserved in the main tank 100. A filter 104 is attached to the immersed opening at the one end of the refilling pipe 102. The refilling pipe 102 is coupled to the inlet side of a refilling pump 106. The outlet side of the refilling pump 106 is communicated to a midway of branch pipe 53 piped to the buffer tank 46. The refilling pump 106 is driven to refill the ink to the buffer tank 46. An overflow pipe 108 is provided between the buffer tank 46 and the main tank 100 to return the ink to the main tank 100 at the time of excessive refilling.

(Control System Configuration)

Figure 2:
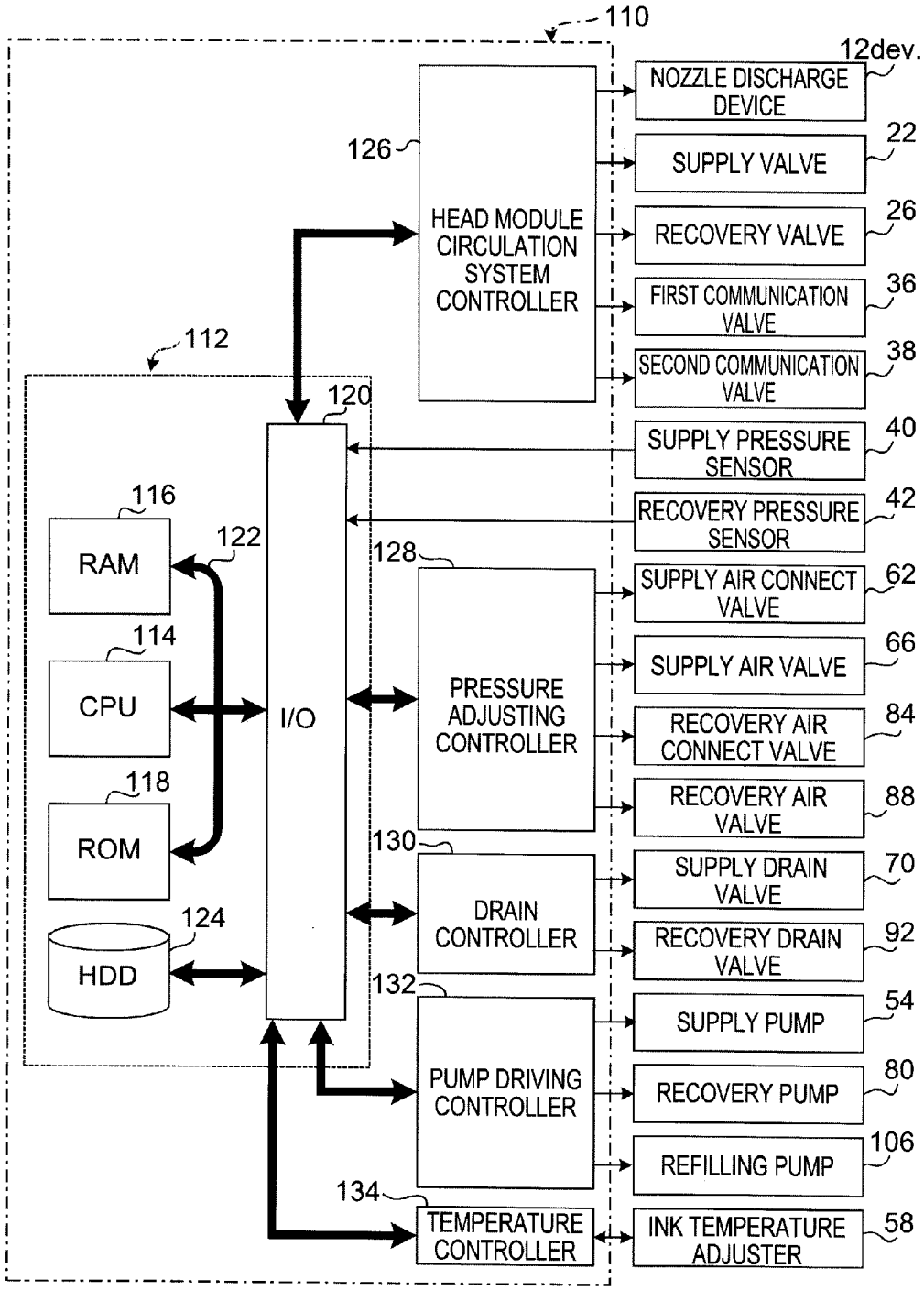
FIG. 2 is a block diagram of an ink supply controller for controlling the operation of the ink jet head according to the present exemplary embodiment.

FIG. 2 shows a block diagram of an ink supply controller 110 for controlling the operation of the ink jet head 10 according to the present exemplary embodiment as an example of a liquid supply controller.

The ink supply controller 110 includes a microcomputer 112. The microcomputer 112 has a CPU 114, a RAM 116, a ROM 118, an input-output interface (I/O) 120, and a bus 122, such as a data bus or a control bus, that connects these components.

The I/O 120 is connected to a hard disk drive (HDD) 124. Further, the I/O 120 is connected to the supply pressure sensor 40 and the recovery pressure sensor 42.

Although not shown, image data for forming an image by discharging the ink from the nozzle of the head module 12 is input to the I/O 120. The image data may be data (raster data) in which ink discharge positions and discharge amounts are defined, or may be compressed image data such as JPEG format data. In this case, the CPU 114 converts the compressed image data to data (raster data) for discharging ink. The CPU 114 reads and executes ink circulation system programs stored in the ROM 118. The ROM 118 stores at least the following control programs, as the ink circulation system programs:

- A circulation control program that causes the ink in the buffer tank 46 to flow and circulate from the supply manifold 14 to the recovery manifold 18.
- A discharge control program that causes the nozzles to discharge ink droplets according to image data.
- A purge control program that causes air bubbles generated in the head module 12 to be discharged (purged).

A storage medium which stores the ink circulation system programs is not limited to the ROM 118, and the ink circulation system programs may be stored in the HDD 124 or an external storage medium and obtained with a reader which reads information by loading the external storage medium or a network such as LAN (both are not shown).

The CPU 114 reads the ink circulation control program, and operates a head module circulation system controller 126, a pressure adjusting controller 128, a drain controller 130, a pump driving controller 132, and a temperature controller 134 based on the read ink circulation control program.

The head module circulation system controller 126 is connected to a nozzle discharge device (e.g., a device which performs an operation of discharging ink droplets from the nozzle by the vibration of a pressure chamber due to energization with respect to a piezoelectric device) 12*dev* incorporated in the head module 12, the supply valve 22, the recovery valve 26, the first communication valve 36, and the second communication valve 38.

The pressure adjusting controller 128 is connected to the supply air valve 62 and the recovery air valve 84.

The drain controller 130 is connected to the supply drain valve 70 and the recovery drain valve 92.

The pump drive controller 132 is connected to the supply pump 54, the recovery pump 80, and the refilling pump 106.

The temperature controller 134 is connected to the ink temperature adjustor 58.

Figure 3:
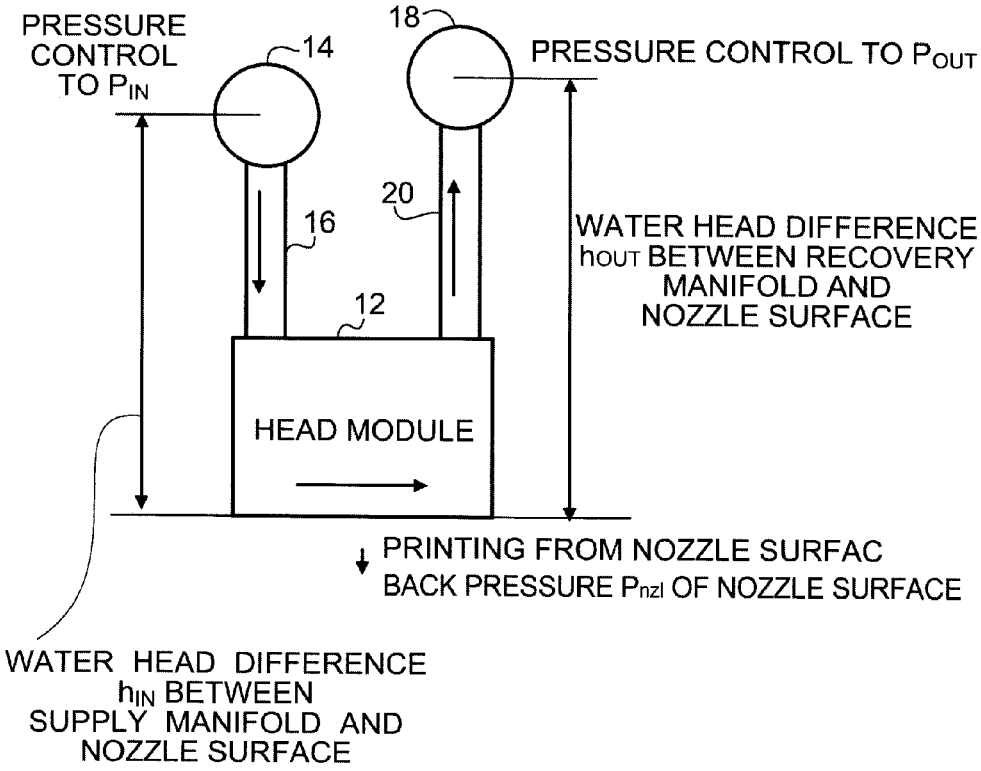
FIG. 3 is a schematic side view showing the pressure relation between a supply manifold and a recovery manifold.

The circulation control program controls the differential pressure ΔP between the supply system and the recovery system to be constant. FIG. 3 shows the principle of specific control of the differential pressure ΔP and the back pressure Pnzl which is the liquid droplet discharge pressure from the head module 12, which is maintained due to the differential pressure ΔP.

As shown in FIG. 3, taking the head module 12 as a reference, there is a difference between the height of the supply manifold 14 and the height of the recovery manifold 18. Hence, there is a water head difference between the supply manifold 14 and the nozzle surface of the head module. Here, the water head difference between the supply manifold 14 and the nozzle surface is indicated by hin [mm], and the water head difference of the recovery manifold 18 and the nozzle surface is indicated by hout [mm].

The ink is supplied to the supply manifold 14 at the pressure Pin due to the driving force of the supply pump 54, and the ink is recovered to the recovery manifold 18 at the pressure Pout due to the driving force of the recovery pump 80. At this time, the pressure Pin and the pressure Pout are negative pressures, respectively, and the pressure Pout is greater than the pressure Pin.

Under the above condition, the back pressure Pnzl of the nozzle surface of the head module 12 is expressed by the following (1) equation.

Further, under the above condition, the differential pressure ΔP between the supply system and the recovery system is expressed by the following (2) equation.

$$Pnzl=(P\text{in}+h\text{in}\times g\times\rho+P\text{out}+h\text{out}\times g\times\rho)/2 \quad (1)$$

$$\Delta P=(P\text{out}+h\text{out}\times g\times\rho)-(P\text{in}+h\text{in}\times g\times\rho) \quad (2)$$

Where,

Pnzl is the discharge pressure (back pressure) of the nozzle surface of the head module 12, Pin is the internal pressure of the supply manifold 14, Pout is the internal pressure of the recovery manifold 18, g is the gravitational acceleration, and ρ is the ink density (in the unit of [g/m$^3$], for example).

In addition, all the pressures are expressed in the unit of [Pa].

In the equations (1) and (2), the water head differences hin and hout and the gravitational acceleration g can be considered as constant values, and when there is no ink change, the ink density ρ can also be considered as a constant value. Accordingly, the adjustment of the differential pressure ΔP and the back pressure Pnzl depends on the pressure Pin in the supply manifold 14 and the pressure Pout in the recovery manifold 18.

For instance, the head module 12 may need to be replaced due to its life or failure. Although the head module 12 is manufactured under predetermined standards, the ink circulation resistance in the head module 12 may be different in respective manufacture lots and individual devices. For this reason, when circulating the ink while maintaining the differential pressure between the supply system and the recovery system, the flow rate of the ink may fluctuated. Such phenomenon may also occur when the ink jet head 10 incorporating the head modules 12 is replaced. This may also occur when the ink is changed to other ink which has different ink viscosities; however, a change of the ink is not considered in the present exemplary embodiment.

In the present exemplary embodiment, in addition to the circulation control program, the discharge control program, and the purge control program, when the flow rate of the ink is fluctuated before and after a replacement of the head module 12, a flow rate control program is executed which controls the differential pressure ΔP while maintaining the back pressure Pnzl within a predetermined allowable range, in order to adjust the flow rate to a proper value.

When the head module 12 is replaced, the driving states (actually, rotational speeds) of the supply pump 54 and the recovery pump 80 are detected. Then, the flow rate is controlled to the proper value by changing the pressures of the supply system and the recovery system stepwise in increments of a fixed amount in opposite directions, respectively, while monitoring the driving states (the rotational speeds) of the supply pump 54 and the recovery pump 80. In the present exemplary embodiment, the rotational speed (revolution rate) is expressed by revolutions per minute (rpm); however, the rotational speed may be expressed in different units such as a linear speed or an angular speed.

Figure 4:
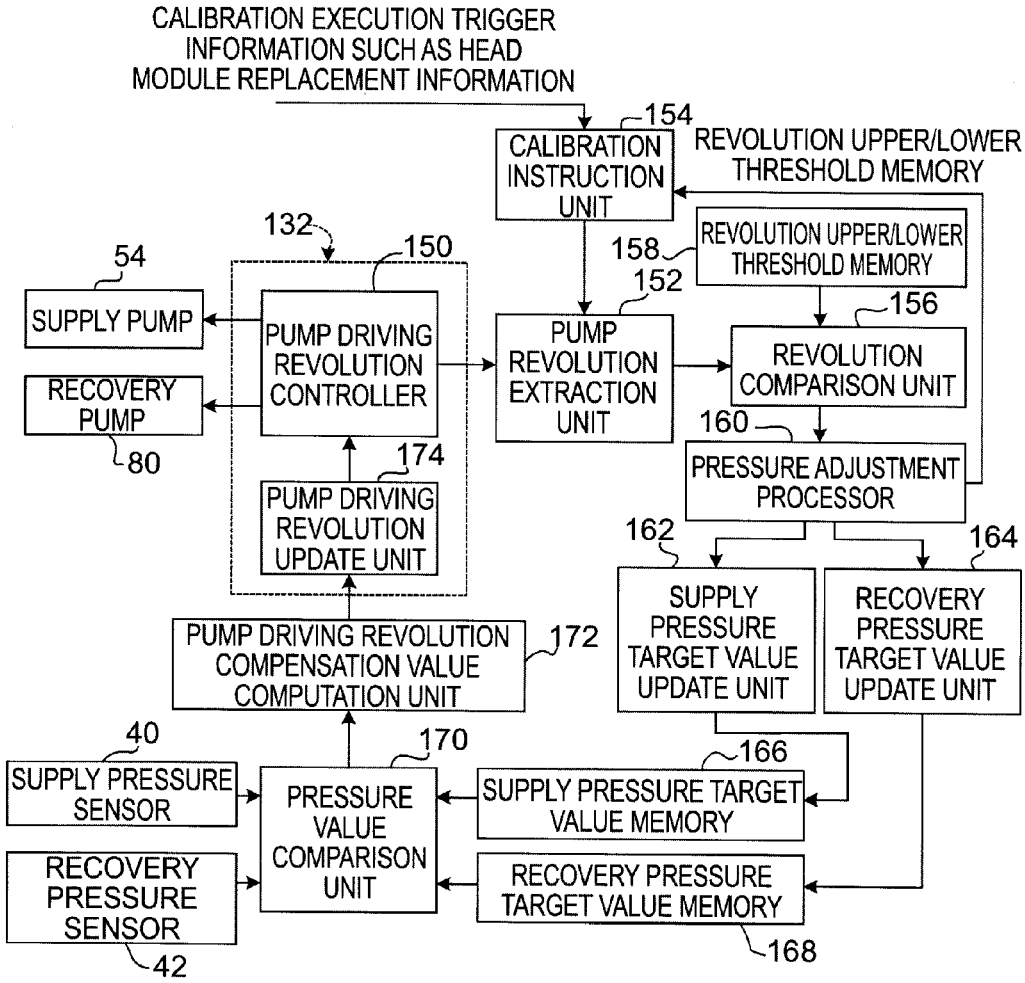
FIG. 4 is a function block diagram of controlling of the flow rate of ink flowing between the supply manifold and the recovery manifold in the ink supply controller.

FIG. 4 shows a function block diagram for controlling the flow rate of the ink flowing between the supply manifold 14 and the recovery manifold 18 in the ink supply controller 110. The function block diagram only shows the functions in blocks, and is not intended to limited to a hardware configuration of the device. For instance, the present exemplary embodiment may be mainly implemented with a software program executed by the microcomputer 112 of the ink supply controller 110.

The supply pump 54 and the recovery pump 80 are connected to a revolution controller 150 provided in the pump drive controller 132, and are driven based on the revolution rate set by the revolution controller 150.

The revolution controller 150 is connected to a revolution extraction unit 152. The revolution extraction unit 152 is connected to a calibration instruction unit 154, and is activated by an instruction signal from the calibration instruction unit 154. The calibration instruction unit 154 outputs the execution instruction signal to the revolution extraction unit 152 when, for instance, information on replacement of the head module is input. The trigger of the output of the execution instruction signal is not limited to the input of the head module replacement information, and may be detections of abrupt environment changes such as ink replacement and relocation of the device.

The revolution extraction unit 152 is connected to a revolution comparison unit 156, and transmits an obtained pump revolution rate Rp to the revolution comparison unit 156. The revolution rate Rp in the supply system and the recovery system is the same when the ink stably flows.

The revolution comparison unit 156 is connected to a revolution upper/lower threshold memory 158, which compares the extracted revolution rate Rp with the revolution upper threshold value and with the revolution lower threshold value.

The revolution comparison unit 156 is connected to a pressure adjustment processor (unit pressure value addition/subtraction processor) 160 and transmits the comparison result to the pressure adjustment processor 160.

In a case in which it is judged that the comparison result is within the allowable range, the pressure adjustment processor 160 transmits a calibration completion signal to the calibration instruction unit 154.

However, in a case in which it is judged that the comparison result is outside the allowable range, the pressure adjustment processor 160 outputs an addition/subtraction instruction signal to each of a supply pressure target value update unit 162 and a recovery pressure target value update unit 164.

The supply pressure target value update unit 162 has the function of updating the current pressure target value Pin in the supply manifold 14. In the present exemplary embodiment, when the pump revolution rate Rp is above the upper limit value, a unit pressure value Pc is subtracted from the current pressure target value Pin (Pin←Pin−Pc), and when the pump revolution rate Rp is below the lower limit value, the unit pressure value Pc is added to the current pressure target value Pin (Pin←Pin+Pc). The computation result is transmitted to a supply pressure target value memory 166, and data (the pressure Pin) in the supply pressure target value memory 166 is updated.

The recovery pressure target value update unit 164 has the function of updating the current pressure target value Pout in the recovery manifold 18. In the present exemplary embodiment, when the pump revolution rate Rp is above the upper limit value, the unit pressure value Pc is added to the current pressure target value Pout (Pout←Pout+Pc), and when the pump revolution rate Rp is below the lower limit value, the unit pressure value Pc is subtracted from the current pressure target value Pout (Pout←Pout−Pc). The computation result is transmitted to a recovery pressure target value memory 168, and data (the pressure Pout) in the recovery pressure target value memory 168 is updated.

Each of the supply pressure target value memory 166 and the recovery pressure target value memory 168 is connected to a pressure comparison unit 170. The pressure comparison unit 170 is connected to the supply pressure sensor 40 and the recovery pressure sensor 42, compares the detection value (the actual measured value) of the supply pressure sensor 40 with the target value stored in the supply pressure target value memory 166, and compares the detection value (the actual measured value) of the recovery pressure sensor 42 with the target value stored in the recovery pressure target value memory 168.

The comparison result of the pressure value comparison unit 170 is transmitted to a revolution compensation value computation unit 172 to compute the compensation values for feedback controlling the revolutions of the supply pump 54 and the recovery pump 80 so that the actual measured pressures (Pin, Pout) become the target values.

The compensation value computed by the revolution compensation value computation unit 172 is transmitted to a revolution update unit 174. The revolution update unit 174 is connected to the revolution controller 150, and updates the target values for the revolution control of the supply pump 54 and the recovery pump 80 by the revolution controller 150.

The operation of the present exemplary embodiment will be described below.

Figure 5:
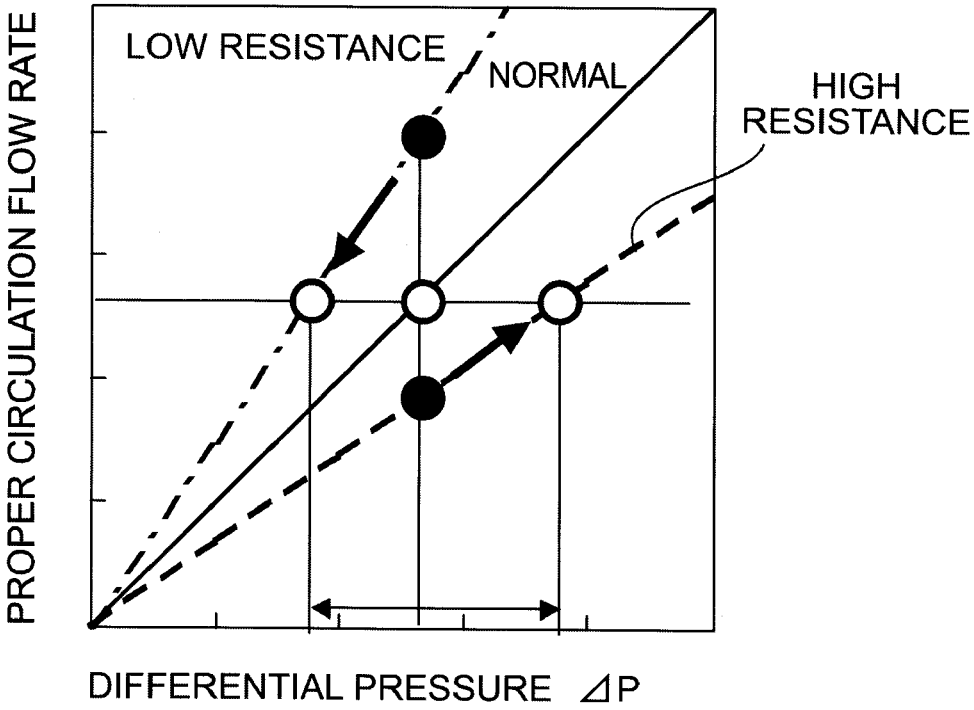
FIG. 5 is a characteristic chart showing the relationship between a differential pressure ΔP and a circulation flow rate.

FIG. 5 shows the relationship between the differential pressure ΔP and the circulation flow rate. When the state indicated with the solid line of FIG. 5 transitions to the low resistance state indicated with the alternate long and short dash line, the flow rate increases, and the differential pressure ΔP is needed to be reduced. When the state indicated with the solid line of FIG. 5 is changed to the high resistance state indicated with the chain line, the flow rate decreases, and the differential pressure ΔP is needed to be increased.

Figure 6:
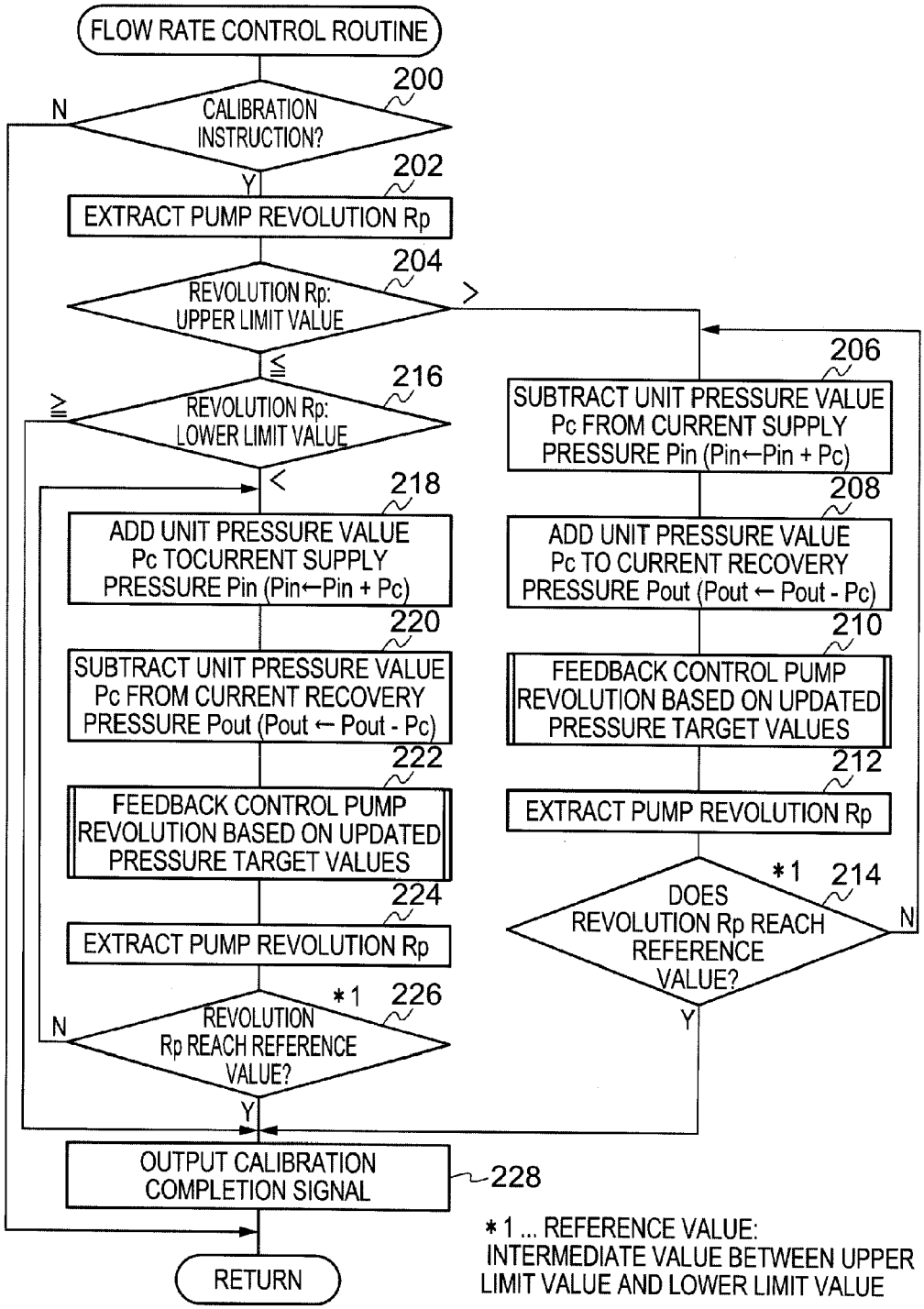
FIG. 6 is a flowchart showing the flow of a pressure control process for controlling the flow rate of ink flowing between the supply manifold and the recovery manifold in the ink supply controller according to the present exemplary embodiment.

FIG. 6 is a flowchart showing the flow of a flow rate (pressure) control program for controlling the flow rate of the ink flowing through the supply manifold 14 and the recovery manifold 18 in the ink supply controller 110 according to the present exemplary embodiment.

In step 200, it is judged whether or not a calibration instruction is output. In a case in which the judgment is negative, the routine is terminated.

In a case in which the judgment is positive in step 200, the routine proceeds to step 202 and obtains the pump revolution rate Rp. Both the supply pump 54 and the recovery pump 80 have the same revolution rate at the time of stable circulation.

In step 204, the obtained revolution rate Rp is compared with the upper limit value and judged whether or not the Rp is above the upper limit value. If it is judged that Rp>the upper limit value, the routine proceeds to step 206.

In step 206, the unit pressure value Pc is subtracted from the current supply pressure Pin (Pin←Pin−Pc). Then, the routine moves to step 208 and the unit pressure value Pc is added to the current recovery pressure Pout (Pin←Pin+Pc), and the routine moves to step 210.

In step 210, feedback control of the pump revolution rate is performed based on the updated pressure target values. That is, the detection values from the supply pressure sensor 40 and the recovery pressure sensor 42 and the pressure target values are compared and the pump revolution rates are corrected so that the difference is compensated for (i.e., the difference is made to be 0).

In step 212, the pump revolution rate Rp is obtained. In step 214, it is judged whether or not the revolution rate Rp reaches a reference value (an intermediate value between the upper limit value and the lower limit value). If the judgment is negative, the routine returns to step 206 and repeats the above process. If the judgment in step 214 is positive, it is determined that calibration is completed, and the routine moves to step 228.

Repeating the compensation until the revolution rate Rp reaches the reference value is only one example of embodiments. Since the aim of the flow rate control can be achieved when the revolution rate Rp is at least below the upper limit value, compensation may be ended at this time.

In step 228, the calibration completion signal is output, and the routine is ended.

When, in step 204, it is judged that Rp the upper limit value, the routine moves to step 216. In step 216, the revolution rate Rp and the lower limit value are compared and judged whether or not the Rp is below the lower limit value. When it is judged that Rp<the lower limit value, the routine move to step 218. When it is judged that Rp≥the lower limit value in step 216, determination is made that calibration is not required, and the routine moves to step 228.

In step 218, the unit pressure value Pc is added to the current supply pressure Pin (Pin←Pin+Pc). Then, the routine moves to step 220, the unit pressure value Pc is subtracted from the current recovery pressure Pout (Pin←Pin−Pc), and the routine moves to step 222.

In step 222, feedback control of the pump rotational speed is performed based on the updated pressure target values. That is, the detection values from the supply pressure sensor 40 and the recovery pressure sensor 42 and the pressure target values are compared and the pump revolution rates are corrected so that the difference is compensated for (the difference is made to be 0).

In step 224, the pump revolution rate Rp is obtained. In step 226, it is judged whether or not the revolution rate Rp reaches the reference value (an intermediate value between the upper limit value and the lower limit value). When the judgment is negative, the routine returns to step 218 and repeats the above process. When, in step 226, the judgment is positive, determination is made that calibration is completed, and the routine moves to step 228.

Repeating the compensation until the revolution rate Rp reaches the reference value is only one example of embodiments. Since the aim of the flow rate control can be achieved when the revolution rate Rp is at least above the lower limit value, compensation may be ended at this time.

In step 228, the calibration completion signal is output, and the routine is ended.

Figure 7A:
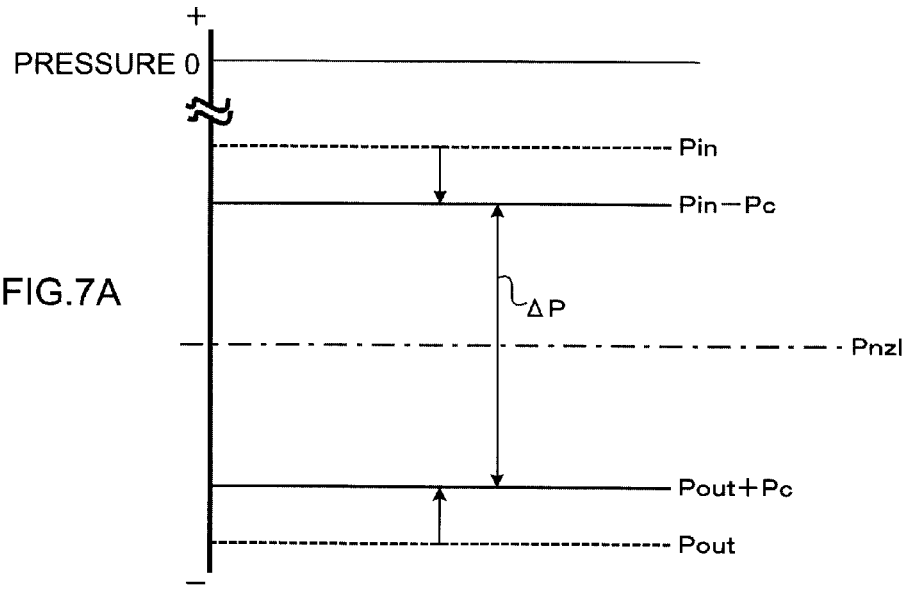
FIGS. 7A and 7B are characteristic charts showing the transition states of the differential pressure ΔP and a back pressure Pnzl in flow rate control (pressure compensation) according to the present exemplary embodiment.
Figure 7B:
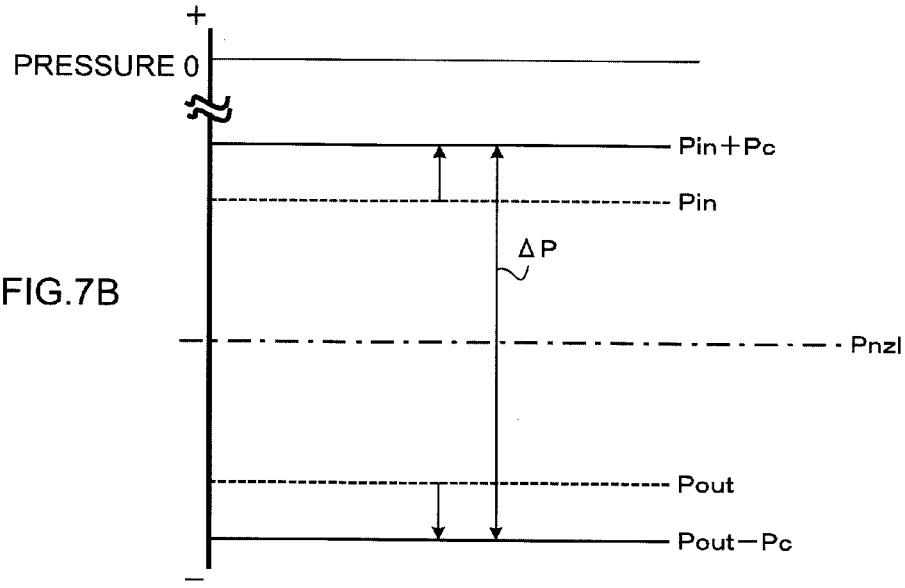

FIGS. 7A and 7B show the transition states of the differential pressure ΔP and the back pressure Pnzl in flow rate control (pressure compensation) according to the present exemplary embodiment. FIG. 7A shows the state of the decrease of the supply pressure Pin in step 206 of FIG. 6 and the increase of the recovery pressure Pout in step 208 of FIG. 6. FIG. 7B shows the state of the increase of the supply pressure Pin in step 218 of FIG. 6 and the decrease of the recovery pressure Pout in step 220 of FIG. 6.

As seen from FIGS. 7A and 7B, since the supply pressure Pin and the recovery pressure Pout are shifted by a fixed amount (the unit pressure Pc) in an opposite direction with each other, the differential pressure ΔP is adjusted while maintaining the back pressure Pnzl.

Modification Example 1

In the above exemplary embodiment, the unit pressure value Pc is added to or subtracted from the supply pressure Pin or the recovery pressure Pout at the time of calibration to order to increase or decrease the differential pressure ΔP, while maintaining the back pressure Pnzl constantly. However, only the recovery pressure Pout may be controlled.

Figure 8:
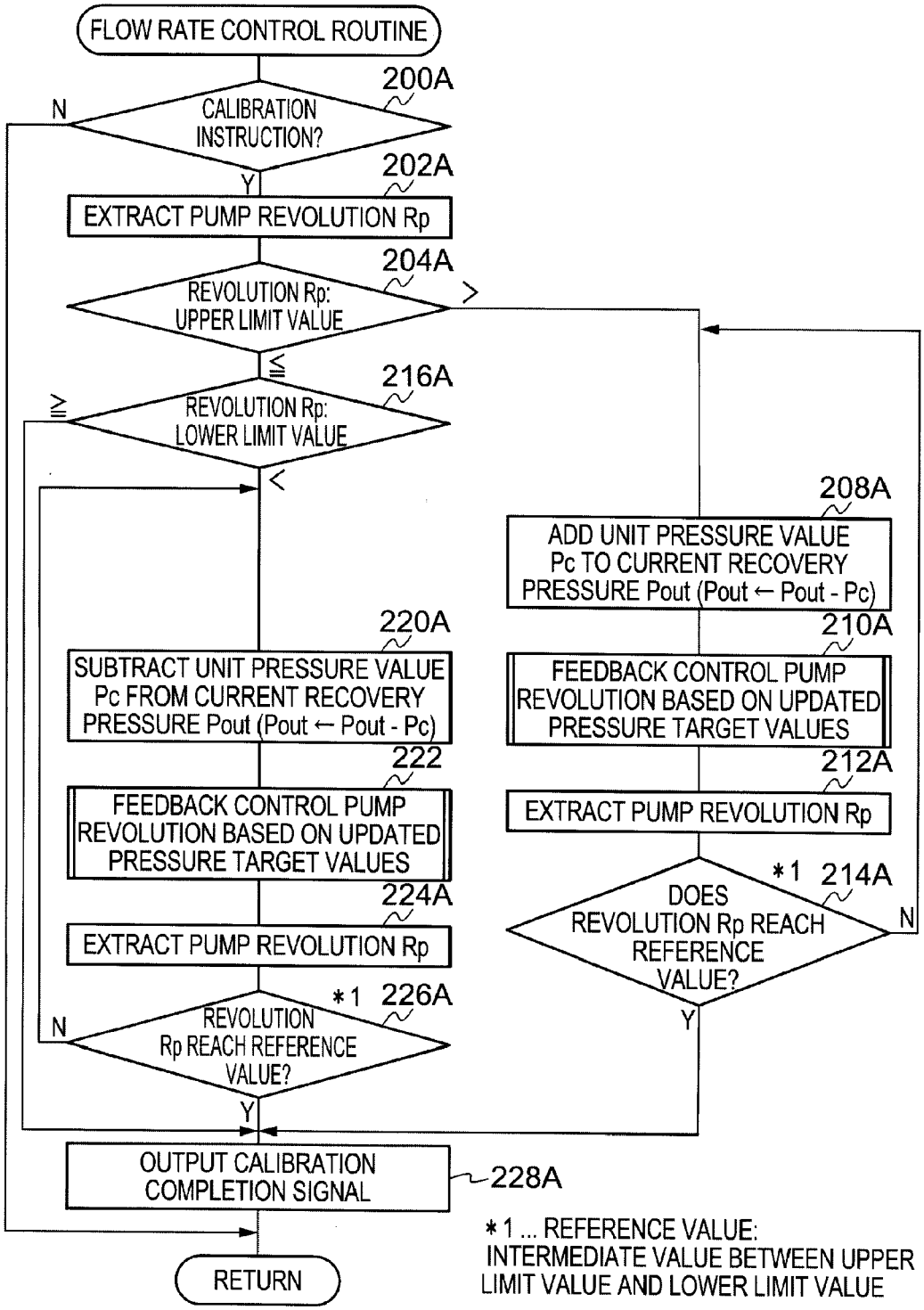
FIG. 8 is a flowchart showing the flow of a pressure control process for controlling the flow rate of ink flowing between the supply manifold and the recovery manifold in the ink supply controller according to modification example 1.

FIG. 8 is a control flowchart according to modification example 1, which is the same as the control flowchart of the present exemplary embodiment shown in FIG. 6, except that steps 206 and 218 of FIG. 6 are omitted and, therefore "A" is appended to the end of each reference numbers and detail descriptions are omitted.

In modification example 1, since only the recovery pressure Pout is subjected to addition/subtraction control, the back pressure Pnzl fluctuates by the control amount (actually, ½ of the control amount of Pc×x: where x is the number of control steps); however, even when the flow rate control is executed in plural steps, the back pressure Pnzl is maintained to a negative pressure at all times.

Figure 9A:
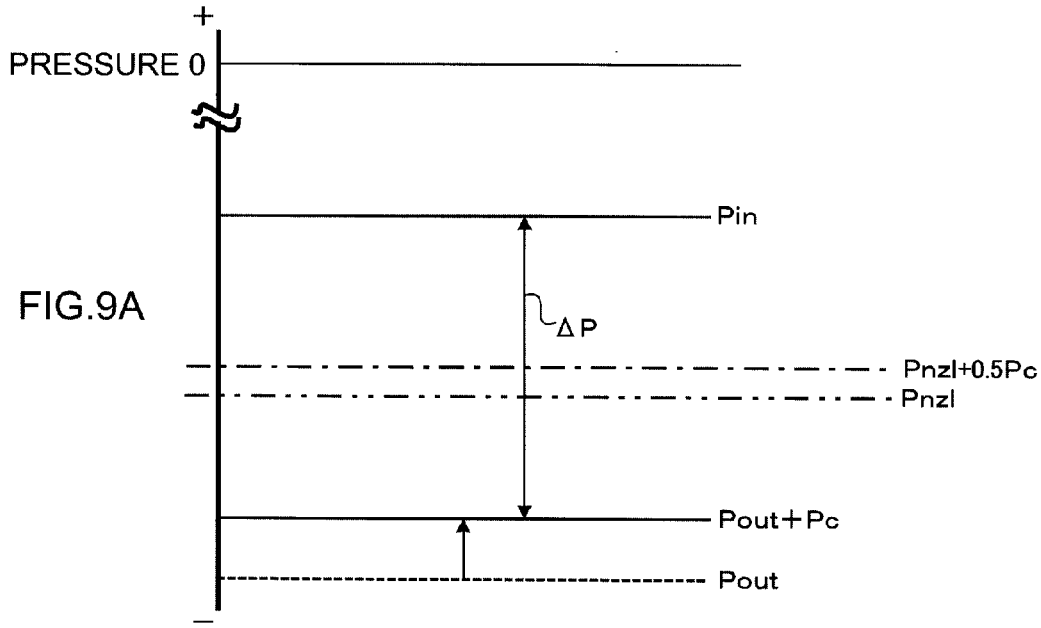
FIGS. 9A and 9B are characteristic charts showing the transition states of the different pressure ΔP and the back pressure Pnzl in the flow rate control (pressure compensation) according to the modification example 1.
Figure 9B:
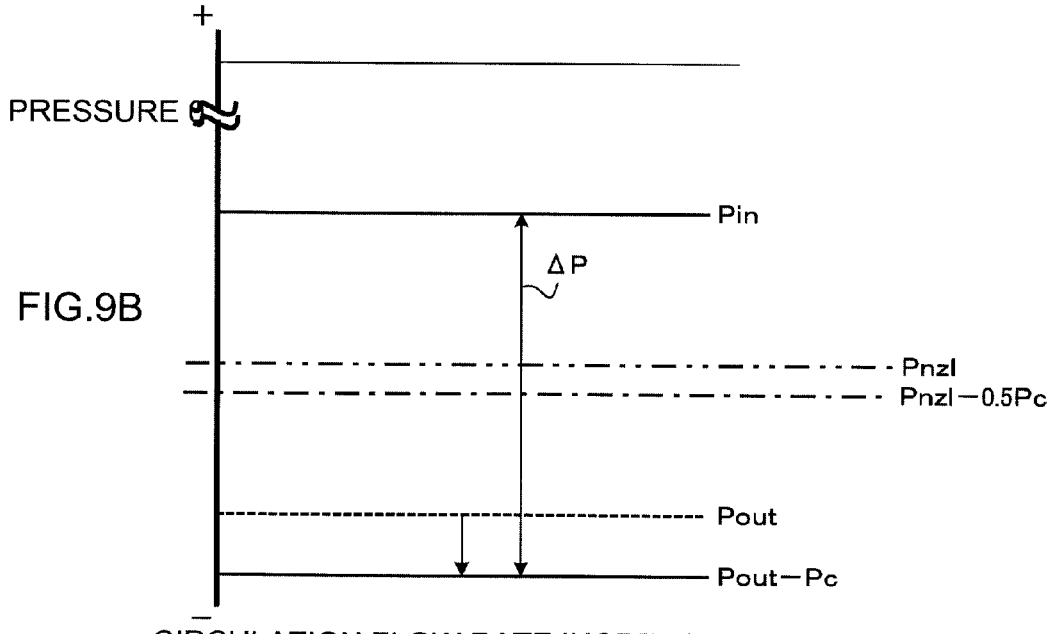

In the above exemplary embodiment, priority is given to the maintenance of the back pressure Pnzl, and in modification example 1, priority is given to the maintenance of the negative pressure of the back pressure Pnzl. FIGS. 9A and 9B show the transition states of the differential pressure ΔP and the back pressure Pnzl in the flow rate control (pressure compensation) according to modification example 1. FIG. 9A shows the state of the increase of the recovery pressure Pout in step 208A of FIG. 8, and FIG. 9B shows the state of the decrease of the recovery pressure Pout in step 220A of FIG. 8.

As seen from FIGS. 9A and 9B, since only the recovery pressure Pout is shifted by a fixed amount (the unit pressure Pc), the differential pressure ΔP is adjusted while the back pressure Pnzl is maintained to a negative pressure. Since the supply pressure Pin which is a negative pressure is fixed, the back pressure Pnzl may not be a positive pressure no matter how long the control is continued. In this case, at least the supply pressure Pin should be 0 or less.

Modification Example 2

In the above exemplary embodiment and modification example 1, the supply pressure Pin and/or the recovery pressure Pout is basically controlled to be varied (increased or decreased) in the unit of the unit pressure Pc. In modification example 2, the supply pressure Pin and the recovery pressure Pout which may provide an optimum flow rate are set in advance in association to the pump revolution rate that has been read, and are stored in a table form. Hereinafter, a pair of the supply pressure Pin and the recovery pressure Pout will be called "a pair of pressures".

FIG. 10 is a table showing the relationship between a revolution rate and a pair of pressures, which is stored in the ROM 118 (alternately, in the HDD 124, an external recording medium, or the like).

In the table of FIG. 10, the pair of pressures Pin and Pout are set with respect to an optimum rotational speed N−0 (e.g., 120 rpm) which corresponds to a differential pressure for calibration differential pressure ΔPd.

In the table, the proper pairs of pressures Pin and Pout are set at rotational speeds N−1 (e.g., 110 rpm), N−2 (e.g., 100 rpm), N+1 (e.g., 130 rpm), and N+2 (e.g., 140 rpm) with respect to the optimum rotational speed N−0. The table of FIG. 10 may be set based on an experiment before shipping or at the time of adjustment in maintenance operation.

Figure 11:
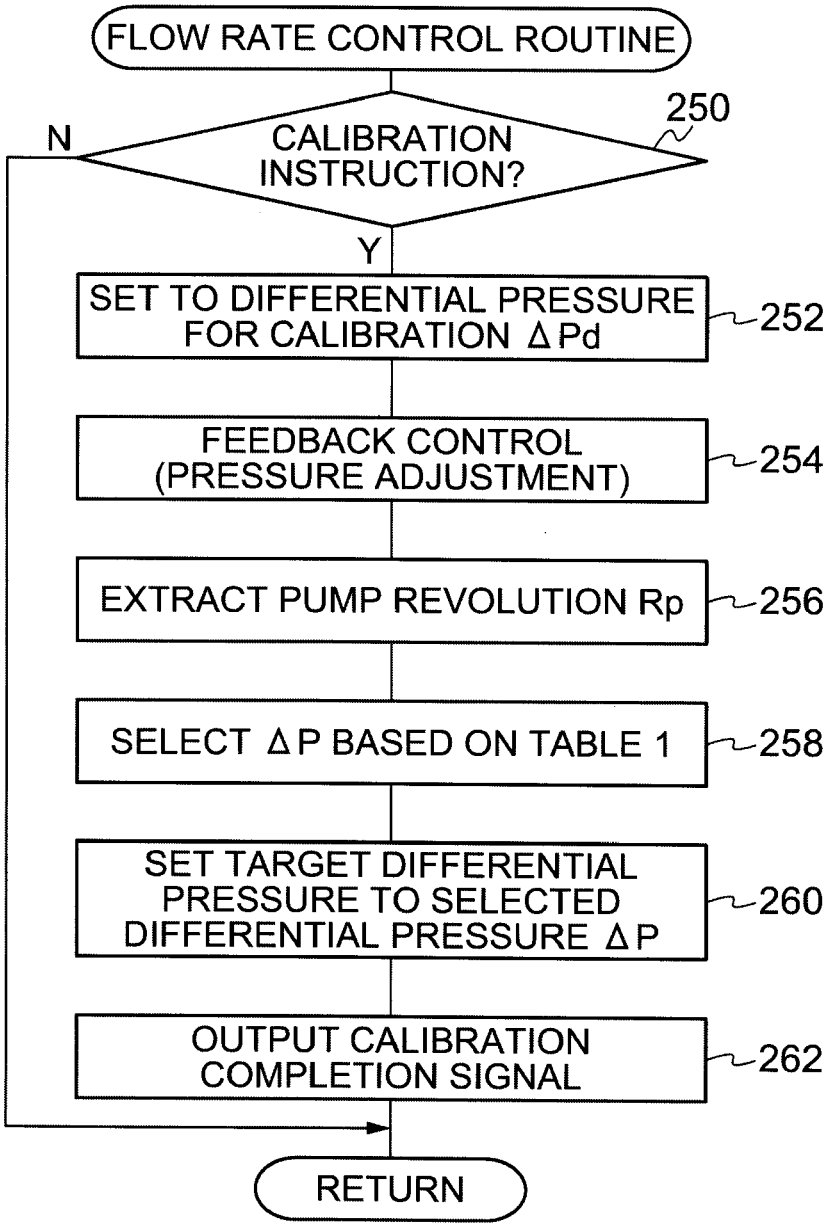
FIG. 11 is a flowchart showing the flow of a pressure control process for controlling the flow rate of ink flowing between the supply manifold and the recovery manifold in the ink supply controller according to the modification example 2.

In a state in which such table is stored in advance, the modification example 2 performs the flow rate control shown in the flowchart of FIG. 11.

In step 250, it is judged whether or not a calibration instruction is output, and when the judgment is negative, the routine is ended.

When the judgment is positive in step 250, the routine moves to step 252 and sets the differential pressure for the calibration differential pressure ΔPd. In step 254, feedback control is executed such that the ink is flowed at the supply pressure Pin and the recovery pressure Pout corresponding to the differential pressure ΔPd.

In step 256, the pump revolution rate Rp is obtained. Then, in step 258, a pair of pressures is selected based on the obtained pump revolution rate Rp from the table shown in FIG. 10.

In step 260, the differential pressure corresponding to the selected pair of pressures (the supply pressure Pin and the recovery pressure Pout) is set as the target differential pressure ΔP, and then, the routine moves to step 262, outputs the calibration completion signal, and the routine is ended.

The foregoing description of the exemplary embodiments has been provided for the purpose of illustration and description. It is not intended to be exhaustive or to limit the invention to the precise form disclosed herein. Obviously, many other modifications and variations will be apparent to a practitioner skilled in the art. The exemplary embodiments are chosen and described in order to best explain the principles of the invention and its practical applications, thereby enabling others skilled in the art to understand the invention according to various embodiments and with various modifications as are suited to the particular use contemplated. The scope of the invention is intended to be defined by the following claims and their equivalents.

What is claimed is:

1. A liquid supply controller comprising:

a liquid circulation controller that comprises a supply unit that supplies a liquid to a liquid droplet discharge unit and a recovery unit that recovers the liquid from the liquid droplet discharge unit, and that circulates the liquid at least according to a differential pressure between a supply pressure of the supply unit and a recovery pressure of the recovery unit;

a back pressure setting unit that sets a back pressure that is a discharge pressure of the liquid droplet discharge unit based on the supply pressure and the recovery pressure set by the liquid circulation controller;

a circulation amount obtaining unit that obtains a flow rate of the liquid circulated by the liquid circulation controller;

a judging unit that judges whether or not the flow rate obtained by the circulation amount obtaining unit is a proper value;

a differential pressure adjusting unit that adjusts the differential pressure while maintaining the back pressure within an allowable range when the judging unit judges that the flow rate is not the proper value; and a storage unit that stores in a table form a plurality of liquid circulation abilities and a pair of pressure setting values of the supply pressure and the recovery pressure for transitioning each of the plurality of liquid circulation abilities to a predetermined proper liquid circulation ability, wherein the differential pressure adjusting unit reads, from the table stored in the storage unit, based on an actual liquid circulation ability obtained by actual measurement, the pair of pressure setting values for transitioning the actually measured liquid circulation ability to the proper liquid circulation ability, and changes the pair of pressure setting values of the supply pressure and recovery pressure at the time of the actual measurement to the read pair of pressure setting values.

2. The liquid supply controller of claim 1, wherein the differential pressure adjusting unit increases or decreases the supply pressure and the recovery pressure in increments of a preset unit pressure amount so that the flow rate transitions to the proper value.

3. The liquid supply controller of claim 1, wherein the differential pressure adjusting unit increases or decreases only the recovery pressure in increments of a preset unit pressure so that the flow rate transitions to the proper value.

4. The liquid supply controller of claim 3, wherein the maintaining of the back pressure within the allowable range is performed by setting a limit value for a pressure adjusting amount by the differential pressure adjusting unit and prohibiting the differential pressure adjusting unit from carrying out a pressure adjustment departing from the limit value.

5. The liquid supply controller of claim 1, wherein the pair of pressure setting values of the supply pressure and recovery pressure at the time of the actual measurement are adjusted to the pair of pressure setting values corresponding to the proper liquid circulation ability in the table stored in the storage unit.

6. The liquid supply controller of claim 1, wherein the liquid circulation ability is a pump revolution rate in the recovery unit and the supply unit.

7. A liquid droplet discharge device comprising:

the liquid supply controller of claim 1;

the liquid droplet discharge unit that is connected to the liquid supply controller and that comprises a discharge port which discharges liquid droplets; and a liquid droplet discharge controller that controls discharge of the liquid droplet discharge unit based on an input signal.

8. A non-transitory computer readable medium storing a program causing a computer to execute a process for controlling a liquid supply, the process comprising:

controlling a liquid circulation unit that comprises a supply unit which supplies a liquid to a liquid droplet discharge unit and a recovery unit which recovers the liquid from the liquid droplet discharge unit, and that circulates the liquid at least according to a differential pressure between a supply pressure of the supply unit and a recovery pressure of the recovery unit;

setting a back pressure as a discharge pressure of the liquid droplet discharge unit based on the supply pressure and the recovery pressure;

obtaining a liquid flow rate at the time of the circulation;

judging whether or not the obtained flow rate is a proper value;

adjusting the differential pressure while maintaining the back pressure within an allowable range when it is judged that the flow rate is not the proper value; and storing in a table form a plurality of liquid circulation abilities and a pair of pressure setting values of the supply pressure and the recovery pressure for transitioning each of the plurality of liquid circulation abilities to a proper liquid circulation ability, wherein the adjustment includes:

obtaining an actual liquid circulation ability by actual measurement;

reading from the stored table, based on the actual liquid circulation ability, the pair of pressure setting values for transitioning the actual liquid circulation ability to the proper liquid circulation ability; and changing the pair of pressure setting values of the supply pressure and recovery pressure at the time of the actual measurement to the read pair of pressure setting values.

9. The non-transitory computer readable medium of claim 8, wherein the adjustment includes increasing or decreasing the supply pressure and the recovery pressure in increments of a preset unit pressure so that the flow rate transitions to the proper value.

10. The non-transitory computer readable medium of claim 8, wherein the adjustment includes increasing or decreasing only the recovery pressure in increments of a preset unit pressure so that the flow rate transitions to the proper value.

11. The non-transitory computer readable medium of claim 10, wherein the maintaining of the back pressure within the allowable range comprises setting a limit value to a pressure adjusting amount in the adjustment and prohibiting adjustment of pressure departing from the limit value.

12. The non-transitory computer readable medium of claim 8, wherein the pair of pressure setting values of the supply pressure and recovery pressure at the time of the actual measurement are adjusted to the pair of pressure setting values corresponding to the proper liquid circulation ability in the stored table.

13. The non-transitory computer readable medium of claim 8, wherein the liquid circulation ability is a pump revolution rate in the recovery unit and the supply unit.

14. A method of controlling a liquid supply, the method comprising:

controlling a liquid circulation unit that comprises a supply unit which supplies a liquid to a liquid droplet discharge unit and a recovery unit which recovers the liquid from the liquid droplet discharge unit, and that circulates the liquid at least according to a differential pressure between a supply pressure of the supply unit and a recovery pressure of the recovery unit;

setting a back pressure that is a discharge pressure of the liquid droplet discharge unit based on the supply pressure and the recovery pressure;

obtaining a liquid flow rate at the time of the circulation;

judging whether or not the obtained flow rate is a proper value;

adjusting the differential pressure while maintaining the back pressure within an allowable range when it is judged that the flow rate is not the proper value; and storing in a table form a plurality of liquid circulation abilities and a pair of pressure setting values of the supply pressure and the recovery pressure for transitioning each of the plurality of liquid circulation abilities to a proper liquid circulation ability, wherein the adjustment includes:

obtaining an actual liquid circulation ability by actual measurement;

reading from the stored table, based on the actual liquid circulation ability, the pair of pressure setting values for transitioning the actual liquid circulation ability to the proper liquid circulation ability; and changing the pair of pressure setting values of the supply pressure and recovery pressure at the time of the actual measurement to the read pair of pressure setting values.

* * * * *